US009732501B2

(12) United States Patent
Kang

(10) Patent No.: US 9,732,501 B2
(45) Date of Patent: Aug. 15, 2017

(54) BOOM DRIVING SYSTEM FOR HYBRID EXCAVATOR AND CONTROL METHOD THEREFOR

(71) Applicant: DOOSAN INFRACORE CO., LTD., Incheon (KR)

(72) Inventor: Byung Il Kang, Gyeonggi-do (KR)

(73) Assignee: Doosan Infracore Co., Ltd., Incheon (KR)

( * ) Notice: Subject to any disclaimer, the term of this patent is extended or adjusted under 35 U.S.C. 154(b) by 390 days.

(21) Appl. No.: 14/375,185

(22) PCT Filed: Jan. 28, 2013

(86) PCT No.: PCT/KR2013/000661
§ 371 (c)(1),
(2) Date: Jul. 29, 2014

(87) PCT Pub. No.: WO2013/115530
PCT Pub. Date: Aug. 8, 2013

(65) Prior Publication Data

US 2015/0267381 A1 Sep. 24, 2015

(30) Foreign Application Priority Data

Jan. 30, 2012 (KR) ..... 10-2012-0008896

(51) Int. Cl.
*E02F 9/22* (2006.01)
*E02F 9/20* (2006.01)

(52) U.S. Cl.
CPC ..... *E02F 9/2221* (2013.01); *E02F 9/2075* (2013.01); *E02F 9/22* (2013.01);
(Continued)

(58) Field of Classification Search
CPC ..... E02F 9/2217; F15B 11/17; F15B 21/14; F15B 2211/20576; F15B 2211/31511;
(Continued)

(56) References Cited

U.S. PATENT DOCUMENTS 5,649,422 A * 7/1997 Baginski ..... B66F 9/22 60/431
7,043,906 B2 * 5/2006 Suzuki ..... E02F 9/2217 60/422

(Continued)

FOREIGN PATENT DOCUMENTS

EP 1571352 A1 9/2005
JP 2006-125566 A 5/2006

(Continued)

OTHER PUBLICATIONS

Chinese Office Action dated Sep. 25, 2015 for Chinese Application No. 201380007127.X, 6 pages.

(Continued)

*Primary Examiner* — Eric Keasel
*Assistant Examiner* — Matthew Wiblin
(74) *Attorney, Agent, or Firm* — John D. Veldhuis-Kroeze; Westman, Champlin & Koehler, P.A.

(57) ABSTRACT

The present disclosure relates to a boom driving system for a hybrid excavator and a control method therefor, and more particularly, to a boom driving system for a hybrid excavator, which drives a hydraulic pump motor so as to move a boom upward and downward, and collects regenerative power of the boom using an electric motor so as to improve fuel efficiency, and a control method for the boom driving system. Provided in exemplary embodiments of the present disclosure is a boom driving system for a hybrid excavator and a control method therefor, which may allow an electric motor generator to normally produce electricity by allowing (Continued)

retraction speed and force of the boom actuator to be controlled to a target speed when a boom is moved downward.

2 Claims, 6 Drawing Sheets

(52) U.S. Cl.
CPC ..... *E02F 9/2203* (2013.01); *E02F 9/2235* (2013.01); *E02F 9/2246* (2013.01); *E02F 9/2289* (2013.01); *E02F 9/2296* (2013.01)

(58) Field of Classification Search
CPC ..... F15B 2211/353; F15B 2211/6652; F15B 2211/88; F15B 11/0423; F15B 11/055
See application file for complete search history.

(56) References Cited

U.S. PATENT DOCUMENTS

| | | | | |
|---|---|---|---|---|
| 8,812,202 | B2 * | 8/2014 | Yamamoto | E02F 9/123 303/112 |
| 9,260,835 | B2 * | 2/2016 | Kang | E02F 3/435 |
| 2003/0221339 | A1 | 12/2003 | Naruse et al. | |
| 2005/0246082 | A1 * | 11/2005 | Miki | E02F 9/2075 701/50 |
| 2008/0110166 | A1 * | 5/2008 | Stephenson | E02F 9/2217 60/414 |
| 2009/0077837 | A1 | 3/2009 | Tozawa et al. | |
| 2009/0165450 | A1 * | 7/2009 | Cherney | E02F 9/2203 60/413 |
| 2012/0055050 | A1 * | 3/2012 | Patel | E02F 9/2025 60/327 |

FOREIGN PATENT DOCUMENTS

| | | | | |
|---|---|---|---|---|
| JP | 2011-144531 | | 7/2011 | |
| KR | 10-2006-0063935 | | 6/2006 | |
| KR | 10-2011-0072723 | | 6/2011 | |
| KR | 20110072723 A | * | 6/2011 | E02F 3/435 |
| KR | 10-2011-0079877 | | 7/2011 | |

OTHER PUBLICATIONS

European Search Report dated Oct. 14, 2015 for European Application No. 13743470.0, 6 pages.

Search Report dated May 15, 2013 and written in Korean with English translation for International Patent Application No. PCT/KR2013/000661 filed Jan. 28, 2013, 5 pages.

* cited by examiner

BOOM DRIVING SYSTEM FOR HYBRID EXCAVATOR AND CONTROL METHOD THEREFOR

CROSS-REFERENCE TO RELATED APPLICATION

This application is a Section 371 National Stage Application of International Application No. PCT/KR2013/000661, filed Jan. 28, 2013 and published, not in English, as WO 2013/115530 on Aug. 8, 2013.

FIELD OF THE DISCLOSURE

The present disclosure relates to a boom driving system for a hybrid excavator and a control method therefor, and more particularly, to a boom driving system for a hybrid excavator, which drives a hydraulic pump motor so as to move a boom upward and downward, and collects regenerative power of the boom using an electric motor so as to improve fuel efficiency, and a control method for the boom driving system.

BACKGROUND OF THE DISCLOSURE

In general, a hybrid excavator includes a hydraulic pump motor for moving a boom upward and downward, an electric motor, which implements power generation and power transmission and is connected to one side of the hydraulic pump motor, and an electric energy storage device such as an ultra-capacitor, which is charged with generated electric power, at the other side of the electric motor.

In addition, a hydraulic fluid discharged from the hydraulic pump motor is provided to the boom via a boom control valve, and by control of the boom control valve, the boom is moved upward, stopped, or moved downward.

The aforementioned configuration of the hybrid excavator will be described in more detail with reference to the attached FIG. 1.

A boom actuator 100 is connected to a boom control valve 125, and the boom control valve 125 is connected to a hydraulic pump motor 120.

The boom control valve 125 has three positions, and the boom control valve 125 allows the boom actuator 100 to perform an upward operation at a first position 126, allows the boom actuator 100 to perform a downward operation at a second position 127, allows the boom actuator 100 to stop the upward and downward operations at a third position 128 that is a neutral position.

The hydraulic pump motor 120 may serve as both a hydraulic pump and a hydraulic motor.

A discharge line 121 and an inlet line 122 are connected to the hydraulic pump motor 120. In addition, the other side of the discharge line 121 and the other side of the inlet line 122 are connected to the boom control valve 125.

In addition, a first control valve 151 is connected to one side of the inlet line 122 on a route that is connected to a drain tank. The first control valve 151 is controlled to be closed by the downward operation of the boom actuator 100 when regenerative energy is collected, and controlled to be opened to discharge the hydraulic fluid when regenerative energy is not collected, or when a flow rate of the hydraulic pump motor 120 exceeds a permissible flow rate.

In addition, a second control valve 152 is connected to one side of the discharge line 121 on a route that is connected to the drain tank. The second control valve 152 is controlled to be closed when the boom is moved upward, and controlled to be opened to discharge the hydraulic fluid when the boom actuator 100 performs the downward operation.

In addition, a motor bypass valve 200, which is connected to the discharge line 121 and the inlet line 122, is provided, and the motor bypass valve 200 connects or disconnects the discharge line 121 and the inlet line 122.

On the other hand, one side of a boom auxiliary line 145 may be connected to the discharge line 121, and a boom auxiliary valve 144 may be provided at the other side of the boom auxiliary line 145. The boom auxiliary valve 144 is controlled to add and supply the hydraulic fluid from a main hydraulic pump to the discharge line 121.

The aforementioned boom driving system for a hybrid excavator in the related art has the following problems.

FIG. 1 illustrates a case when assuming that a permissible flow rate of the hydraulic pump motor is larger than a regenerative flow rate in the boom driving system.

A high-pressure fluid (hydraulic fluid) at a head side of a boom cylinder of the boom actuator 100 is transmitted to an intake side of the hydraulic pump motor 120. The hydraulic pump motor 120 implements a hydraulic motor function by pressurized oil (hydraulic fluid), and rotates the electric motor. As a result, the electric motor regenerates electric energy from potential energy of the boom, and the electric energy storage device is charged with electric energy.

A low-pressure hydraulic fluid passing through the hydraulic pump motor 120 is supplied to a rod side of the boom cylinder of the boom actuator 100, and a surplus amount of hydraulic fluid due to a difference in cylinder area is discharged to the drain tank via the second control valve 152.

When the boom is moved downward, a retraction speed of the boom actuator 100 is controlled by a rotational speed of the boom electric motor. That is, as illustrated in FIG. 2A, the rotational speed of the electric motor is increased proportionally to boom downward movement joystick pressure.

In a case in which the amount and pressure of hydraulic fluid, which is supplied from a boom head side of the boom actuator 100, are sufficient, the boom electric motor is operated by the hydraulic pump motor 120 that is operated as a hydraulic motor, and in this case, the electric motor implements a generator function, such that torque of the electric motor has a minus (−) value, as illustrated by a solid line indicated in FIG. 2B.

However, when the boom of the excavator is moved downward, for example, when the excavator performs excavation work on the slope, the amount and pressure of hydraulic fluid, which is supplied from the boom head side of the boom actuator 100, are insufficient. Accordingly, power, which is supplied from the boom cylinder of the boom actuator 100 to the hydraulic pump motor 120, may be insufficient.

The electric motor is operated as an electric motor using electric power from the electric energy storage device (capacitor), as illustrated by a dotted line indicated in FIG. 2B, so as to be rotated at a desired rotational speed, as illustrated in FIG. 2A, and in this case, torque of the electric motor has a plus (+) value.

High pressure needs to be formed at the cylinder rod side of the boom actuator 100 in order to implement a predetermined speed or more at which the boom actuator is retracted in a case in which the boom of the excavator is moved downward. However, the electric motor may be rotated at a target speed in the boom driving system for a hybrid excavator in the related art, but pressure in the discharge line 121 is maintained to be low because the discharge line 121 is connected to the drain tank via the second control valve 152.

Accordingly, there is a problem in that a speed at which the rod of the boom actuator 100 is retracted and force by which the rod of the boom actuator 100 is retracted cannot be controlled to be increased.

LITERATURE OF RELATED ART

Patent Literature 1: Korean Patent Application Laid-Open No. 10-2011-0072723 (Jun. 29, 2011)

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

Accordingly, in accordance with some exemplary embodiments of the present disclosure a boom driving system for a hybrid excavator and a control method therefor are provided, which may allow an electric motor generator to normally produce electricity by allowing retraction speed and force of the boom actuator to be controlled to a target speed when a boom is moved downward.

A technical problem to be achieved in the present disclosure is not limited to the aforementioned technical problem, and any other not-mentioned technical problem will be obviously understood from the description below by those skilled in the technical field to which the present disclosure pertains.

In some exemplary embodiments, a boom driving system for a hybrid excavator according to the present disclosure includes: an electric motor which is operated as a motor or a generator; an electric energy storage device which stores electricity produced by the electric motor; a hydraulic pump motor 120 which is operated by the electric motor and supplies a hydraulic fluid to a boom actuator 100; a boom control valve 125 which configures a closed circuit so as to selectively connect or disconnect a discharge line 121 of the hydraulic pump motor 120 and an inlet line 122 of the hydraulic pump motor 120 to/from a head side or a rod side of a boom cylinder that operates the boom actuator 100; a first control valve 151 which connects the inlet line 122 to a drain tank; a second control valve 300 which connects the discharge line 121 to the drain tank, and of which the opening area is controlled to be changed according to a size of torque that is applied to a boom electric motor when the boom actuator 100 performs a downward operation; and a control unit 160 which controls the electric motor, the hydraulic pump motor 120, the boom control valve 125, and the first and second control valves 151 and 300.

In addition, the first control valve 151 of the boom driving system for a hybrid excavator according to the present disclosure may be connected when the boom actuator 100 performs an upward operation, and shut off when the boom actuator 100 performs the downward operation, and the second control valve 300 may be shut off when the boom actuator 100 performs the upward operation, and connected when the boom actuator 100 performs the downward operation.

In addition, a control method for a boom driving system for a hybrid excavator according to some exemplary embodiments of the present disclosure includes: a first detecting step S10 of detecting a value of boom downward movement joystick pressure; a second detecting step S20 of detecting operating torque of a boom electric motor; a determining step S30 of determining whether the operating torque detected in the second detecting step S20 has a plus (+) value or a minus (−) value; a first performing step S40 of maximally opening a second control valve 300 when the operating torque has a minus (−) value in the determining step S30; and a second performing step S50 of controlling an opening area of the second control valve 300 to be reduced when the operating torque has a plus (+) value in the determining step (S30).

Specific items of other exemplary embodiments are included in the detailed description and the drawings.

According to some exemplary embodiments of the boom driving system for a hybrid excavator and the control method therefor according to the present disclosure, which are configured as described above, a retraction speed of the boom actuator may be controlled to a target speed and force when the boom is moved downward, thereby allowing an electric motor generator to normally produce electricity.

DESCRIPTION OF MAIN REFERENCE NUMERALS OF DRAWINGS

Figure 1:
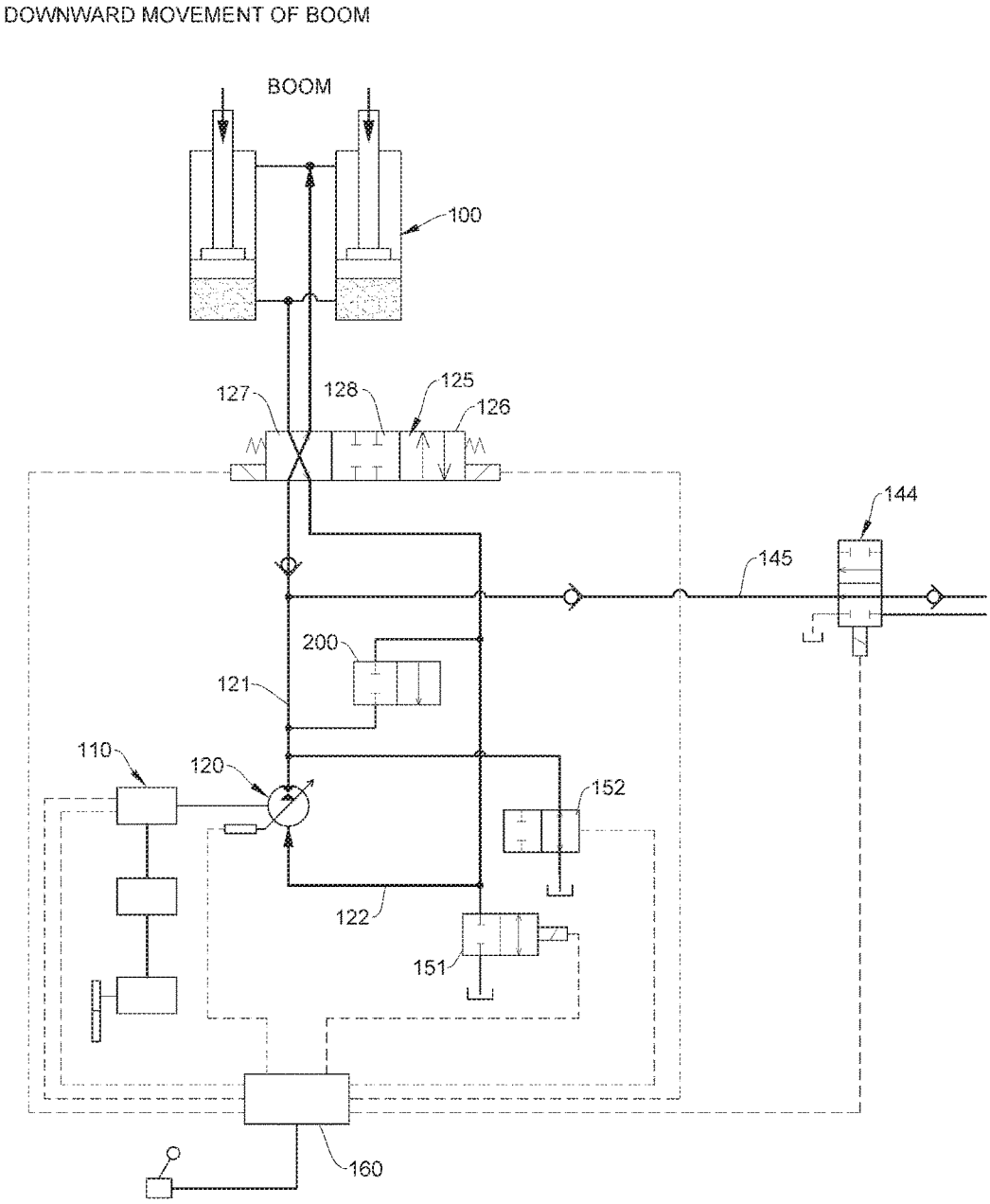
Fig. 1 Prior Art
FIGS. 1 and 2 are views for explaining a boom driving system for a hybrid excavator in the related art.
Figure 2:
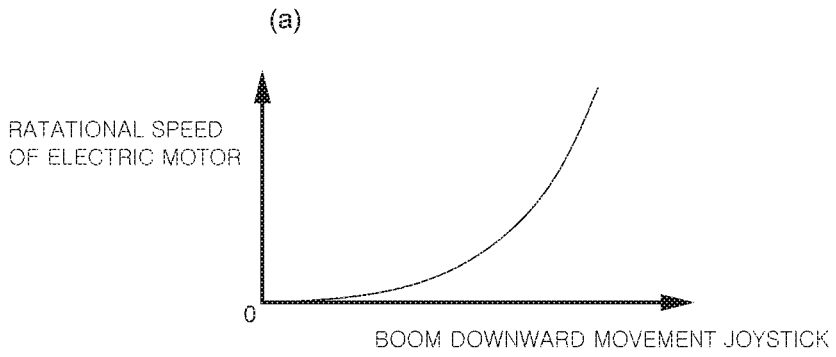
Fig. 2 Prior Art
Figure 2:
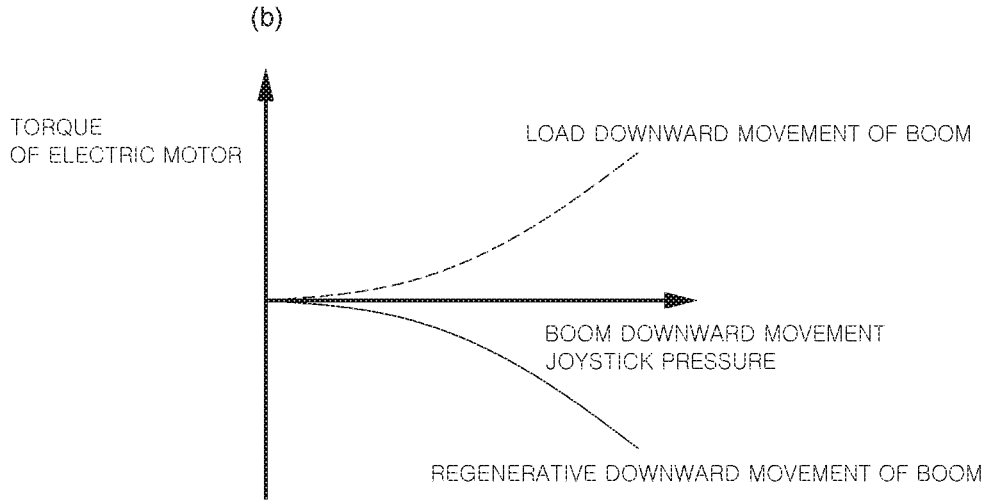
Fig. 2 Prior Art

- 100: Boom actuator
- 110: Electronic device (electric motor, electric energy storage device, inverter, etc.)
- 120: Hydraulic pump motor
- 121: Discharge line
- 122: Inlet line
- 125: Boom control valve
- 126, 127, 128: First, second, and third positions
- 144: Boom auxiliary valve
- 145: Boom auxiliary line
- 151, 152: First and second control valves
- 160: Control unit
- 200: Motor bypass valve
- 300: Second control valve
- 301: Completely opened position
- 302: Opening area reducing position

303: Completely closed position

DETAILED DESCRIPTION

Advantages and features of some embodiments of the present disclosure and methods of achieving some or all of the advantages and features will be clear with reference to an exemplary embodiment described in detail below together with the accompanying drawings.

Like reference numerals indicate like elements throughout the specification, constituent elements identical to constitute elements in the related art will be indicated by the same reference numerals, and duplicated detailed descriptions thereof will be omitted.

Meanwhile, the terms used in the description are defined considering the functions of the present disclosure and may vary depending on the intention or usual practice of a manufacturer. Therefore, the definitions should be made based on the entire contents of the present specification.

Hereinafter, a boom driving system for a hybrid excavator and a control method therefor according to an exemplary embodiment of the present disclosure will be described with reference to FIGS. 3 to 6.

Figure 3:
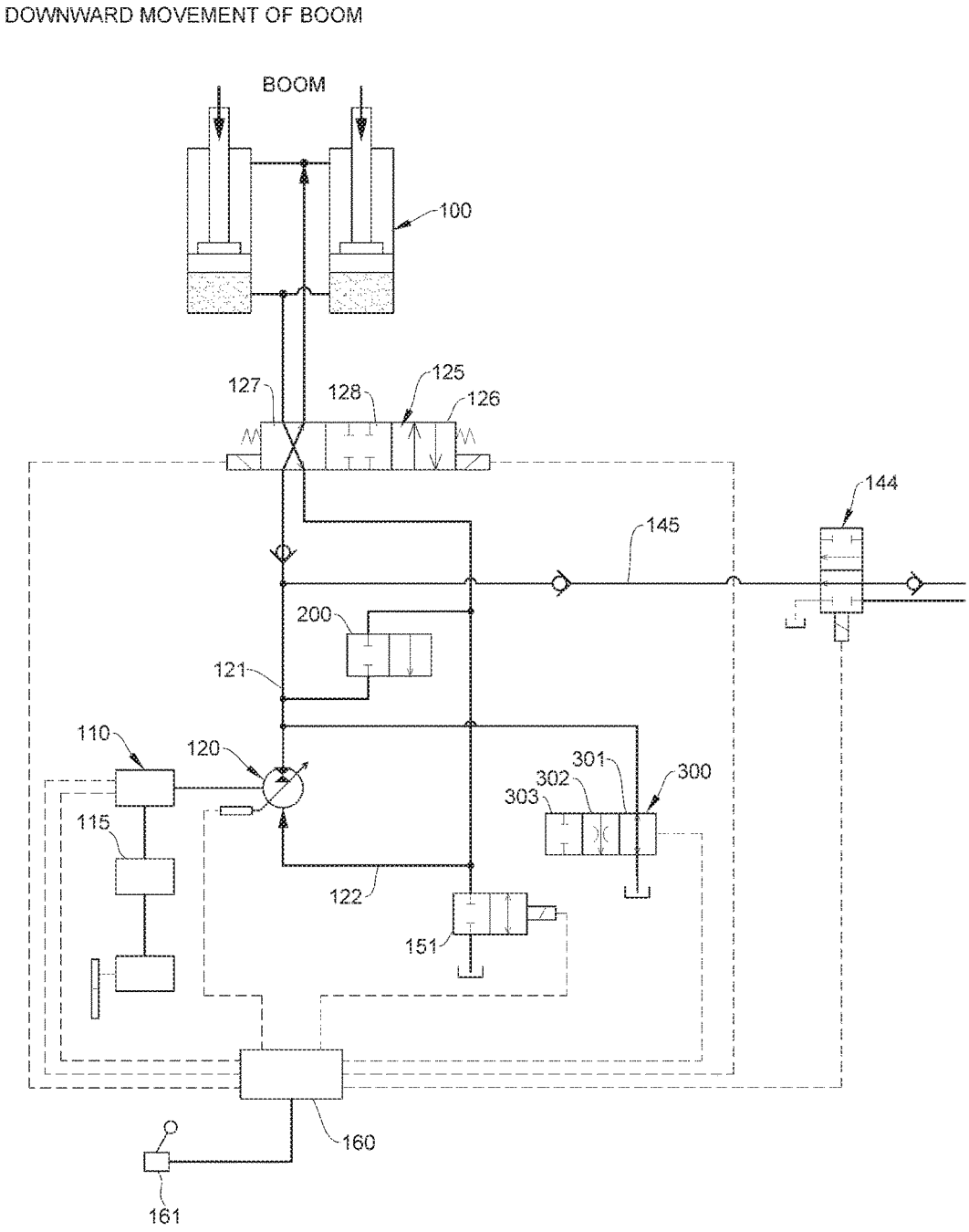
FIGS. 3 and 4 are views for explaining a boom driving system for a hybrid excavator and a control method therefor according to an exemplary embodiment of the present disclosure, and for explaining a regenerative downward movement of a boom and a load downward movement of the boom when the boom is moved downward.
Figure 4:
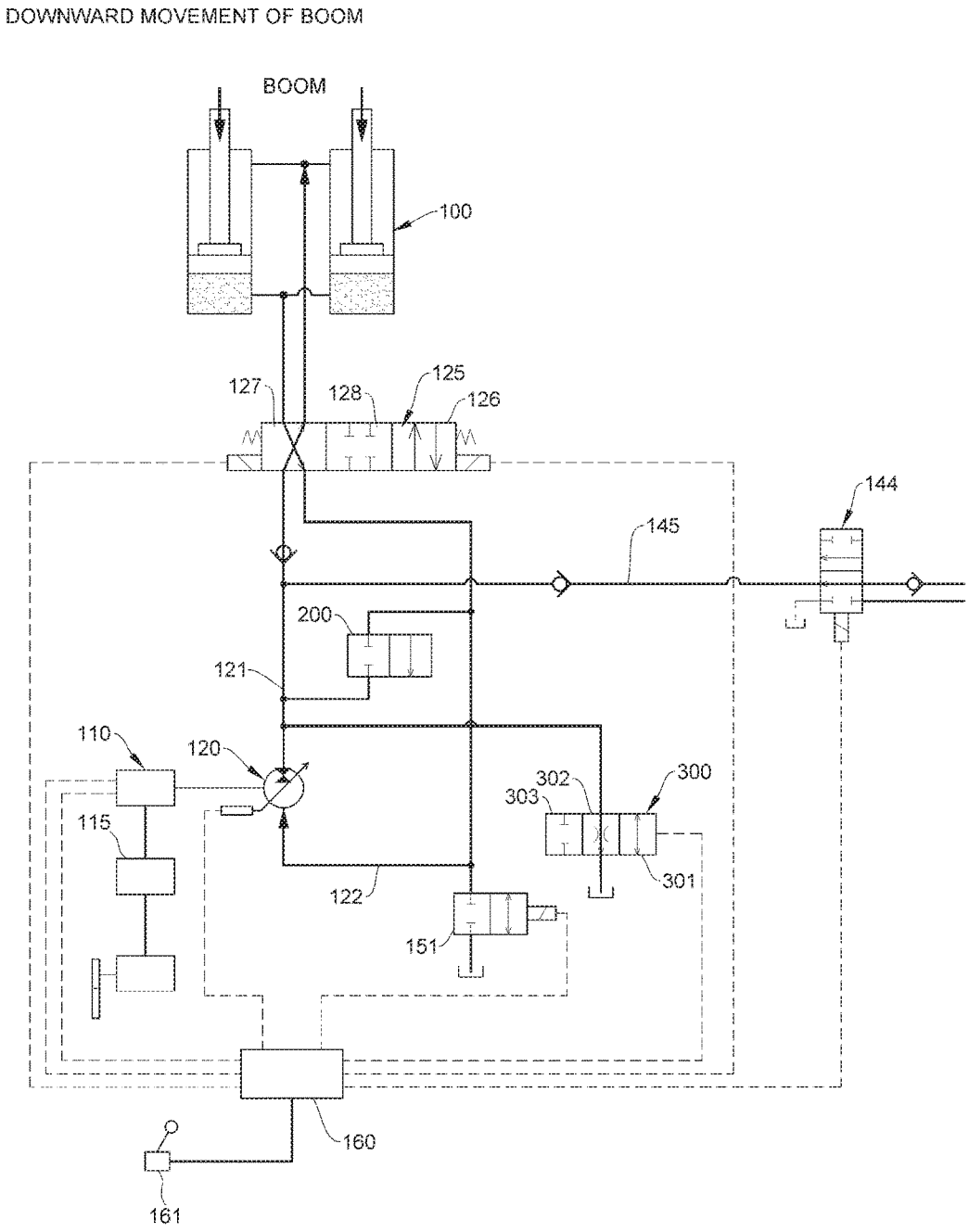
Figure 5:
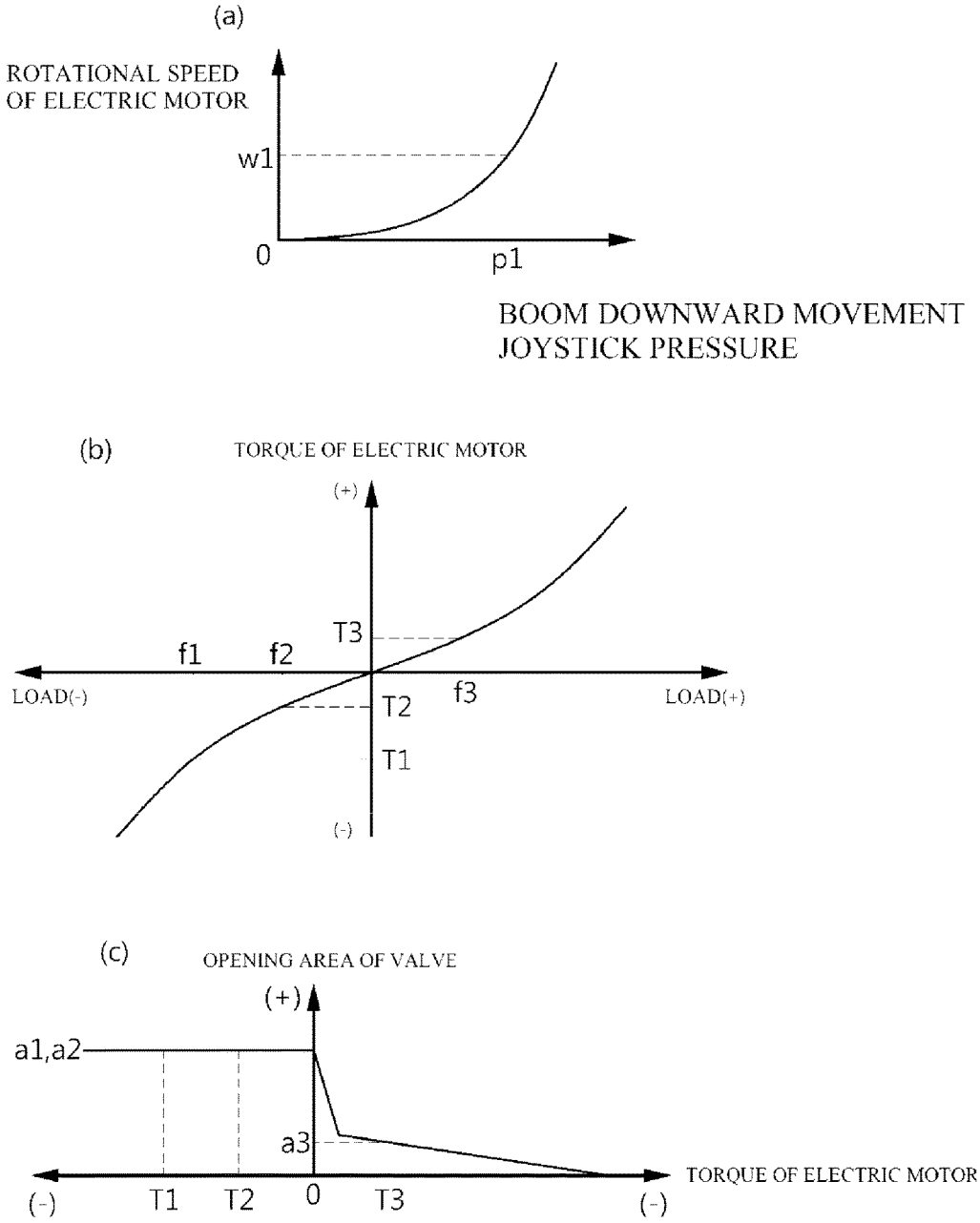
FIG. 5 is graphs for explaining characteristics of the boom driving system for a hybrid excavator according to the exemplary embodiment of the present disclosure.
Figure 6:
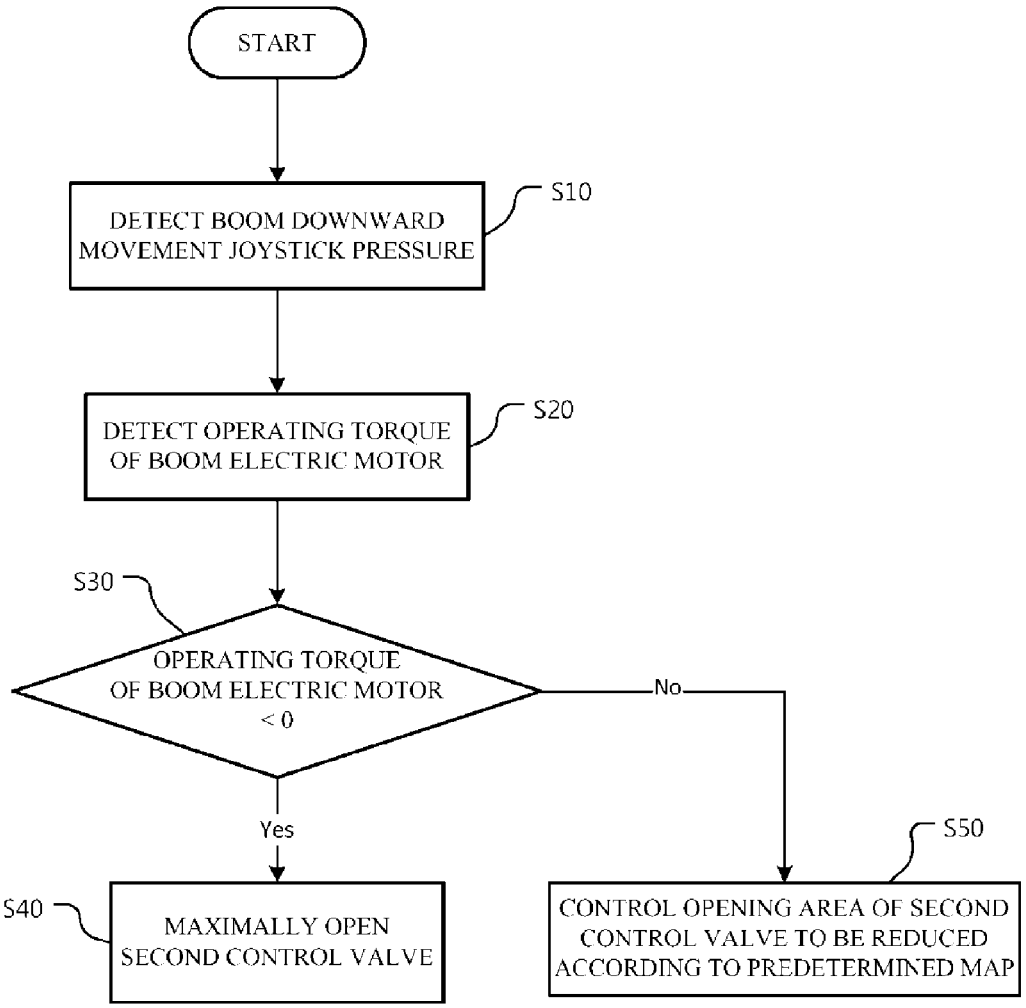
FIG. 6 is a flowchart for explaining the boom driving system for a hybrid excavator and the control method therefor according to the exemplary embodiment of the present disclosure.

The attached FIGS. 3 and 4 are views for explaining the boom driving system for a hybrid excavator and the control method therefor according to the exemplary embodiment of the present disclosure, and for explaining a regenerative downward movement of a boom and a load downward movement of the boom when the boom is moved downward. The attached FIG. 5 shows graphs for explaining characteristics of the boom driving system for a hybrid excavator according to the exemplary embodiment of the present disclosure. The attached FIG. 6 is a flowchart for explaining the boom driving system for a hybrid excavator and the control method therefor according to the exemplary embodiment of the present disclosure.

The boom driving system for a hybrid excavator according to the exemplary embodiment of the present disclosure is configured by coupling an electronic device and a hydraulic device.

The electronic device includes an electric motor, an electric energy storage device 115, an inverter, and the like. The electric motor is operated as a motor or a generator. The inverter stabilizes an operation of the electric motor. The electric energy storage device 115 stores electricity produced by an electric motor.

The hydraulic device includes a boom actuator 100, a hydraulic pump motor 120, and a boom control valve 125.

The hydraulic pump motor 120 may serve as both a hydraulic pump and a hydraulic motor. When the hydraulic pump motor 120 is operated as a hydraulic pump, the hydraulic pump motor 120 is operated by the electric motor so as to supply a hydraulic fluid to the boom actuator 100. When the hydraulic pump motor 120 is operated as a hydraulic motor, the hydraulic pump motor 120 is operated by the hydraulic fluid discharged from the boom actuator 100 so as to operate the electric motor.

A discharge line 121 and an inlet line 122 are connected to one side of the hydraulic pump motor 120. The other side of the discharge line 121 and the other side of the inlet line 122 are connected to the boom control valve 125.

The boom control valve 125 may be connected in a forward direction in order to allow the boom actuator 100 to perform an upward operation, may be connected in a reverse direction in order to allow the boom actuator 100 to perform a downward operation, and may have a neutral position so as to stop the upward and downward operations of the boom actuator 100.

On the other hand, one side of a boom auxiliary line 145 may be connected to the discharge line 121, and a boom auxiliary valve 144 may be provided at the other side of the boom auxiliary line 145. The boom auxiliary valve 144 is controlled to add and supply the hydraulic fluid from a main hydraulic pump to the discharge line 121.

On the other hand, the boom driving system for a hybrid excavator according to the exemplary embodiment of the present disclosure may further include a first control valve 151 which connects the inlet line 122, which connects the hydraulic pump motor 120 and the boom control valve 125, to a drain tank for draining the hydraulic fluid. In addition, the boom driving system may further include a second control valve 300 which connects the discharge line 121, which connects the hydraulic pump motor 120 and the boom control valve 125, to the drain tank for draining the hydraulic fluid.

A control unit 160 controls the first control valve 151 and a second control valve 300.

In more detail, the first control valve 151 is connected when the boom actuator 100 performs the upward operation, and shut off when the boom actuator 100 performs the downward operation.

The second control valve 300 is shut off when the boom actuator 100 performs the upward operation, and connected when the boom actuator 100 performs the downward operation.

In addition, the second control valve 300 may be provided as a three-position and two-port type. A first position may be a completely opened position 301, a second position may be an opening area reducing position 302, and a third position may be a completely closed position 303.

Here, an opening area of the second control valve 300 through which the hydraulic fluid passes is changed according to a position of a spool.

Meanwhile, in a case in which a required flow rate, which corresponds to a signal of an upward movement of the boom, exceeds a supply flow rate of the hydraulic pump motor 120, or exceeds a capacity of the electric motor 110, the boom auxiliary valve 144 may be controlled to be opened so that the hydraulic fluid discharged from a first hydraulic pump 141 is supplied to the boom actuator 100.

In addition, in a case in which a flow rate of hydraulic fluid, which flows from the boom actuator 100 into the hydraulic pump motor 120, exceeds a permissible flow rate of the hydraulic pump motor 120, or exceeds a power generation capacity of the electric motor 110 when the boom actuator 100 performs the downward operation, the first control valve 151 may be connected to the tank and may discharge a surplus amount of hydraulic fluid to the tank.

Hereinafter, the control method for the boom driving system for a hybrid excavator according to the exemplary embodiment of the present disclosure will be described with reference to the attached FIGS. 5 and 6.

First detecting step S10: a value of boom downward movement joystick pressure is detected.

Second detecting step S20: operating torque of the boom electric motor is detected.

Determining step S30: whether the operating torque detected in the second detecting step S20 has a plus (+) value or a minus (−) value is determined.

First performing step S40: when the operating torque has a minus (−) value in the determining step S30, the second control valve 300 is maximally opened. That is, a position of the second control valve 300 is controlled to the completely opened position 301.

Second performing step S50: when the operating torque has a plus (+) value in the determining step S30, the opening area of the second control valve 300 is controlled to be reduced. That is, the opening area is controlled to be smaller than the maximum opening area.

In the exemplary embodiment of the present disclosure, as a reference for determining a regenerative downward movement or a load downward movement, a value of the operating torque, which is applied to the electric motor, is determined. In more detail, the regenerative downward movement is determined when the operating torque has a minus (−) value, and the load downward movement is determined when the operating torque has a plus (+) value. Here, the operating torque is torque of the electric motor which is controlled to rotate the electric motor at a target rotational speed.

When the load downward movement of the boom is performed, the second control valve 300 is controlled such that pressure in the discharge line 121, which is connected with the cylinder rod of the boom actuator, is controlled when the boom is moved downward.

When the load downward movement of the boom is performed, a position of the second control valve 300 is controlled to the opening area reducing position 302, such that a flow path connected to the drain tank may be reduced, and as a result, pressure in the discharge line 121 is increased. The pressure, which is increased as described above, is transmitted to the cylinder rod side of the boom actuator 100, and as a result, a speed at which the boom actuator 100 is retracted may be controlled to a desired speed.

Hereinafter, an operation of the second control valve 300 will be described with reference to the graphs illustrated in FIG. 5.

When the regenerative downward movement of the boom is performed, the second control valve 300 is maximally opened. The boom electric motor is operated by the hydraulic pump motor 120 that is operated as a hydraulic motor by pressurized oil that is supplied through the inlet line 122 from a cylinder head of the boom actuator 100. In this case, pressure of a joystick 161 is defined by p1, and a rotational speed of the electric motor is defined by w1.

In this case, an external load, which is applied to the boom actuator 100, is f1, and torque, which is finally transmitted to the boom electric motor, is T1. The boom electric motor regenerates power by w1×T1. In this case, the second control valve 300 is maximally opened, as illustrated in FIG. 5C.

Meanwhile, as external force is applied to a bucket, a regenerable load may be decreased from f1 to f2. In this case, torque, which is transmitted to the boom electric motor, is decreased from T1 to T2. However, even in this case, the boom electric motor regenerates power by T2. Similarly, the second control valve 300 is maximally opened, as illustrated in FIG. 5C.

On the other hand, when a larger amount of external force is applied to the bucket, pressure in the inlet line 122 may not rotate the boom electric motor at a target rotational speed illustrated in FIG. 5A. The boom electric motor is rotated using electric power from the electric energy storage device 115, and in this case, an external load is defined by f3, and torque of the electric motor is defined by T3.

In this case, when torque of the boom electric motor is changed from a minus (−) value to a plus (+) value, the control unit 160 controls the second control valve 300 so that the opening area thereof through which a fluid will pass is decreased to a3. If required torque of the electric motor becomes larger as an external load becomes greater than f3, the second control valve 300 is finally closed such that the overall hydraulic fluid discharged by the hydraulic pump motor is transmitted to the rod side of the boom actuator 100, thereby increasing downward force when the boom is moved downward.

When the opening area of the second control valve 300 connected to the drain tank is decreased, pressure in a flow path of the discharge line 121 is increased. This pressure is transmitted to the rod side of the boom cylinder of the boom actuator 100 so as to control the boom cylinder at a desired speed.

According to the boom driving system for a hybrid excavator and the control method therefor according to the exemplary embodiment of the present disclosure, which are configured as described above, a retraction speed of the boom actuator may be controlled to a target speed when the boom is moved downward, thereby allowing an electric motor generator to normally produce electricity.

The exemplary embodiments of the present disclosure have been described with reference to the accompanying drawings, but those skilled in the art will understand that the present disclosure may be implemented in any other specific form without changing the technical spirit or an essential feature thereof.

Accordingly, it should be understood that the aforementioned exemplary embodiment is described for illustration in all aspects and are not limited, and the scope of the present disclosure shall be represented by the claims to be described below, and it should be construed that all of the changes or modified forms induced from the meaning and the scope of the claims, and an equivalent concept thereto are included in the scope of the present disclosure.

The boom driving system for a hybrid excavator and the control method therefor according to the present disclosure may be used to move the boom upward, and collect regenerative energy when the boom is moved downward.

The invention claimed is:

1. A boom driving system for a hybrid excavator, comprising:

an electric motor which is operated as a motor or a generator;

an electric energy storage device which stores electricity produced by the electric motor;

a hydraulic pump motor which is operated by the electric motor and supplies a hydraulic fluid to a boom actuator;

a boom control valve which configures a closed circuit so as to selectively connect or disconnect a discharge line of the hydraulic pump motor and an inlet line of the hydraulic pump motor to/from a head side or a rod side of a boom cylinder that operates the boom actuator;

a first control valve which connects the inlet line to a drain tank;

a second control valve which connects the discharge line to the drain tank, and of which the opening area is controlled to be changed according to a size of torque that is applied to the electric motor when the boom actuator performs a downward operation; and a control unit which controls the electric motor, the hydraulic pump motor, the boom control valve, and the first and second control valves, wherein the control unit determines whether operating torque of the electric motor has a plus value or a minus value, and controls the second control valve to be maximally opened when the operating torque has the minus value and controls the opening area of the second control valve to be reduced when the operating torque has the plus value.

2. The boom driving system of claim 1, wherein the first control valve is connected when the boom actuator performs an upward operation, and shut off when the boom actuator performs the downward operation, and the second control valve is shut off when the boom actuator performs the upward operation, and connected when the boom actuator performs the downward operation.

* * * * *